United States Patent [19]

Brown

[11] 3,987,581

[45] Oct. 26, 1976

[54] CONTROLLED MULTIPLE TRACK TOY SYSTEM WITH MODULAR ATTACHMENTS

[76] Inventor: Paul L. Brown, 982 Lakeview Way, Redwood City, Calif. 94062

[22] Filed: May 27, 1975

[21] Appl. No.: 580,602

[52] U.S. Cl. ..... 46/44; 46/206; 273/86 D; 273/126 R

[51] Int. Cl.[2] ..... A63H 29/16

[58] Field of Search ..... 46/44, 206, 202, 1 K; 273/86 R, 86 D, 119 B, 129 G, 126 R, 126 A; 302/31; 104/155; 243/3

[56] References Cited

UNITED STATES PATENTS

| | | | |
|---|---|---|---|
| 1,899,706 | 2/1933 | McClean | 273/86 D |
| 3,136,088 | 6/1964 | Crandall | 46/44 X |
| 3,367,658 | 2/1968 | Bayha | 46/44 X |
| 3,429,544 | 2/1969 | Williams | 273/126 A |
| 3,611,622 | 10/1971 | Lemelson | 46/44 |
| 3,722,888 | 3/1973 | Ducharme | 273/126 R |

*Primary Examiner*—Louis G. Mancene
*Assistant Examiner*—Jack Q. Lever

[57] ABSTRACT

A system wherein a plurality of selected objects are caused to move as a group at regulated speeds within a defined oval-shaped level area simulating a race track as well as to stop and go individually and separately apart from the group, and wherein a plurality of different individual objects are caused to move at regulated speeds over different locations about said level area, as well as wherein a simulated airplane landing and take-off strip is defined within said oval-shaped area for periodic controlled movement of a flight object thus enabling a series of events to occur separately and simultaneously at the will of the user.

8 Claims, 20 Drawing Figures

21
21
26
31
32
33
34
50
56
51
52
53
54
55
27
57
50
41

6
73
74
72
76
77
78
79
71
69
68
67
66
6

72
39
92
38
37
36
49
65
40
76
64
48
40
77
63
78
47
7
7
40
62
79
40
46
61
14
71
69
68

67
66

14
68
66
78
67

81
86
87
83
49
65
64
65
88
64
84
92
82
40

100
97
96
99
94
98'
10
10
91
98
98'
97
92

83

40
14

105
105
107
106
108
105
105

99
94
96
93
98
97
100
90
92
98'
100'
98
100
91
14

108
101
103
104
106
109
104
40
14

132 A

133 A
131 A 112
113
115
111
114

120
117
112

111
121
119

18
120
115
117
116
120
111
118
119
18
40
14

121A
124A
126A
123 A
128 A
130
122A

125 A
127A
129 A 126
128
128
132

14
40

126
20

131
132
128
129
127
20
40
14

CONTROLLED MULTIPLE TRACK TOY SYSTEM WITH MODULAR ATTACHMENTS

The present invention relates generally to those types of games which have heretofore been devised for indoor amusement principally and that can be enjoyed by a number of children as well as adults, both male and female, with the game board disposed on the floor of a game room or even on a table about which the players are grouped. More particularly, the present invention pertains to systems powered either electrically pneumatically or hydraulically for effecting the movement of objects and articles over a surface at regulated or controlled speeds. Among systems of this type which have been the subject of prior patents is the game apparatus disclosed and claimed in U.S. Pat. No. 1,897,706, issued on Feb. 28, 1933, the invention therein illustrated comprising a raceway over which jets of air are delivered to propel spherical counters around the raceway; the apparatus including means for imparting an initial impulse to the counters to get them simultaneously into the air jets zone as well as means for bringing the counters to a point of rest sequentially after having traversed the raceway. The air jets are created by a motor-driven fan. Another prior invention of somewhat the same idea is disclosed in the Bayha patent, U.S. Pat. No. 3,367,658 issued by the U.S. Patent office on Feb. 6, 1968, entitled Air Jet Toy which comprises a flat-bottomed board for resting upon the seat of an automobile; the air supply being delivered by a tube 16' having a diverging throat opening to the exterior of the automobile for scooping air into the tube in response to the forward movement of the vehicle, and delivering the scooped air into the housing 34 for release to the raceway 42 upon which miniature automobiles are placed for propulsion about the raceway. Air propulsion from bellows to drive minature objects over a game board are shown in the patent to Wilson, U.S. Pat. No. 2,571,081, issued Oct. 9, 1961, and U.S. Pat. No. 3,697,071 discloses a toy system comprising a pair of endless transparent tracks housing toy trains which are actuated by fluid pressure controlled by a constant flow-type valve, thus controlling the speed of the projectile or train along the conduit track. My present invention constitutes a meritorious advance in the art which enables the enjoyment of the system by adults as well as children with a plurality of objects of different character simultaneously in motion to simulate conventionally moving objects such as racing automobiles, aeroplane movements as well as regulated movements of movable objects at confined areas.

A primary object of the present invention is to provide a multiple track toy system wherein group movements of selected objects and individual movements of different objects are simultaneously controlled.

Another important object of my invention is to provide a multiple track toy system of the indicated nature which is additionally characterized by its capability of bringing any selected one moving object of a group of moving objects to an absolute stop.

A still further object of my present invention is to provide a multiple track toy system of the aforementioned character which is augmented by the inclusion in the system of modular novel components movable in endless closed circuits, as well as to and fro linear directions, and in reciprocation both linearly as well as vertically.

Other objects of the invention, together with some of the advantageous features thereof will appear from the following descriptions of preferred and modified embodiments thereof inclusive of unique modular components as illustrated in the accompanying drawings exemplifying the best mode of construction of the invention and the manner of using the same.

Referring to the drawings.

Figure 16:
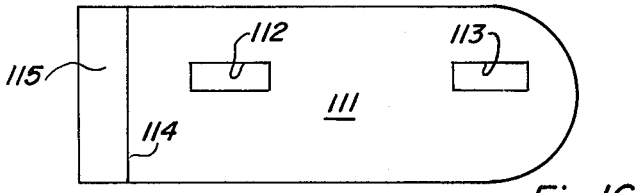
FIG. 16 is a plan view of a mount for another modular component embodied in a two-wheel toy auto as depicted in FIG. 17.
Figure 17:
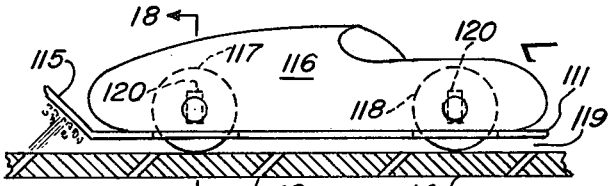

FIG. 17 is a side elevational view of a toy auto silhouette adhesively secured to the mount of FIG. 16 but with the assist-vane of the mount lifted and showing in fragmentary cross-section a portion of the vented top of the game board of my present invention and illustrating the air cushion ride; this view showing in dotted lines the floating mount of the simulated vertically movable wheels of the modular component.

Figure 18:
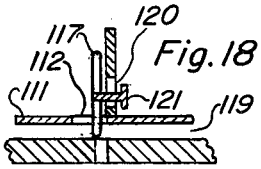

FIG. 18 is a sectional elevational view of the modular component illustrated in FIG. 17 and taken on line 18—18 thereof; this view illustrating the floating mount of the simulated car wheels extending through the modular component of FIG. 17.

Figure 19:
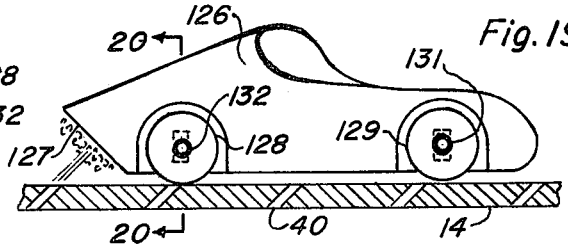

FIG. 19 is a side elevational view of a still further modular component embodied in a four wheel toy auto with assist-vane defined at the rear of the toy; this view also showing a cross-sectional segment of the vented top of my improved game board and the air cushion ride of the component.

Figure 20:
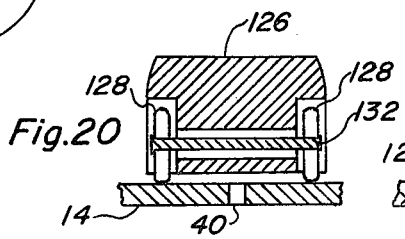

FIG. 20 is a sectional elevational view of the modular component shown in FIG. 19 and taken on the line 20—20 thereof; this view illustrating the vented top of the game board utilized in my present invention and also the floating mount of the rear axle in the vertical slots of the three dimensional toy allowing frictional engagement of the car wheels with the track surface.

Figure 1:
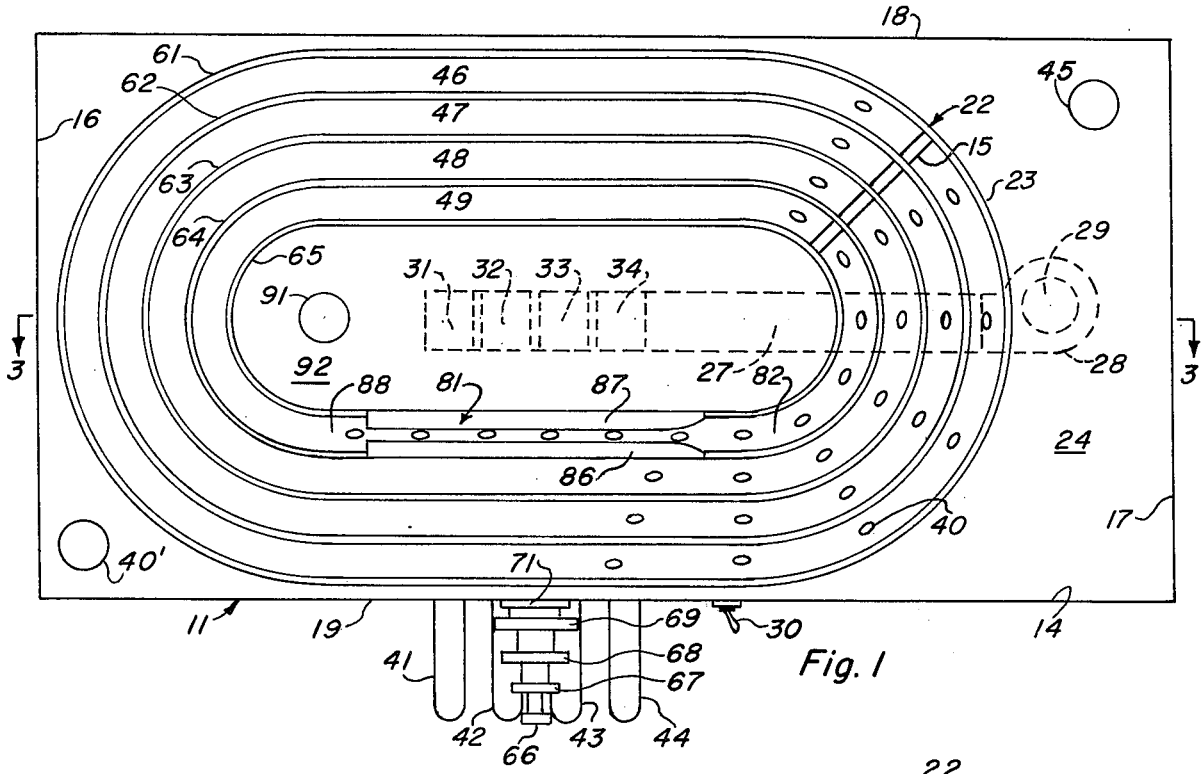
FIG. 1 is a plan view of the upper surface of a game board utilized in an embodiment of my present invention, with fragmentary showing of vents and dotted line showing of control ports.
Figure 2:
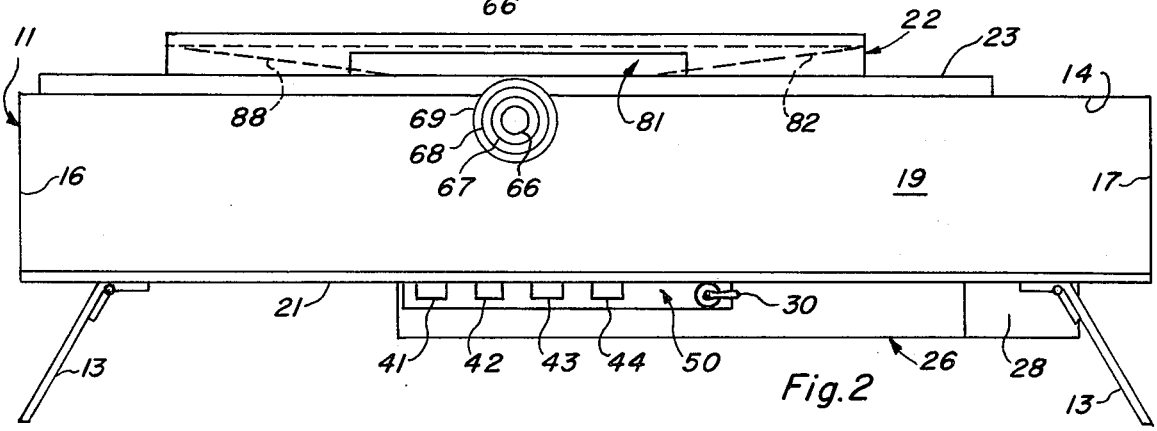
FIG. 2 is a front elevational view of the game board shown in FIG. 1; this view illustrating the superstructure defining an aircraft take-off and landing strip in dotted lines and also locations of control levers.
Figure 3:
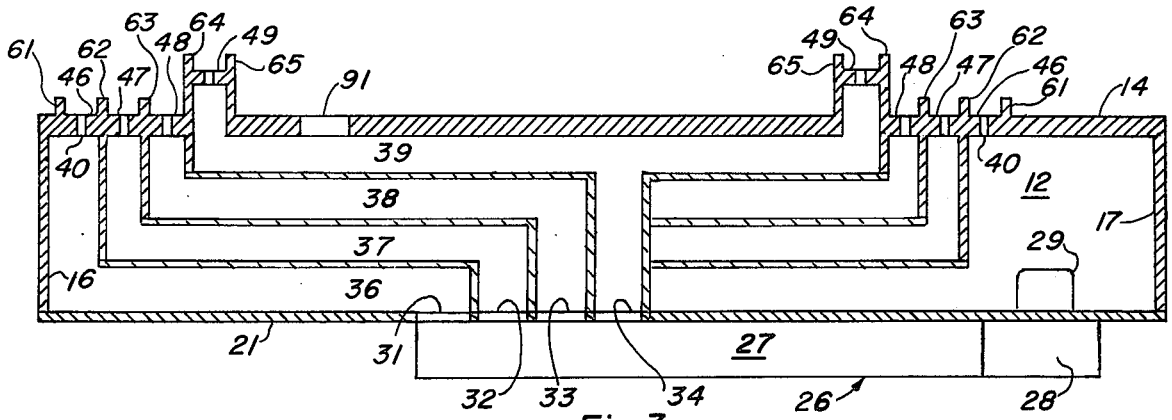
FIG. 3 is a sectional elevational view of the improved game board and conduit system; this view being taken on the line 3—3 of FIG. 1.

As particularly illustrated in FIGS. 1–3 inclusive of the annexed drawings, my improved multi-track system with modular componets is embodied in a housing 11 which defines a relatively large interior compartment 12 and which conveniently is supported at its four corners on legs 13 of which but two are shown in the drawings, see FIG. 2, thus enabling the housing to be set upon any desired planar surface to afford a level game board on which a plurality of objects can be caused to move at the will of the operator or user of the system. Any suitable material can be employed for constructing the housing 11, such as wood, or a light-weight metal such as aluminum or an alloy thereof, or from any suitable plastic material such as a phenol or urea condensate. Conveniently, the housing 11 may be fashioned in an elongated rectangular shape to include a multi-apertured top 14, a pair of ends 16 and 17, a pair of sides 18 and 19, and a multi-apertured bottom 21. As shown in FIGS. 2 and 3, a super-structure which is generally designated by the reference numeral 22, is affixed to the top 14 and divides the top into a multi-track section 23 and a modular component area 24.

In accordance with my prevent invention, I fasten to the underside of the apertured bottom 21 of housing 11 a hollow casing 26 which defines an air pressure chamber 27 in which is housed a blower 28 conveniently connected to the shaft of an electrical motor 29 and driven thereby; such motor being connected into an electrical circuit by a conventional electrical cord and attached plug, all not shown, for placing the motor 29 into connection with a source of electrical energy, also not shown. The electrical circuit is provided with a standard on and off switch 30 for controlling the starting and stopping of the motor 29 which may be conveniently seated on the inside of bottom 21 of housing 11. The air chamber 27 is placed in communication with ducts housed in compartment 12 of the housing through a series of valve-controlled apertures 31, 32, 33 and 34 in the bottom 21 of housing 11 which in turn communicate with the super-posed oval-shaped air conduits 36, 37, 38 and 39 arranged in deck formation within compartment 12 and each thereof vented to the atmosphere above the top 14 of housing 11 through a plurality of jet holes 40 arranged at random locations in the top in spaced apart relationship. For purposes hereinafter explained some of the jet holes 40 are drilled through top 14 at an incline in one direction from the vertical while some of the jet holes are inclined in an opposite direction from the vertical, and other jet holes 40′ are drilled vertically through the top 14 of the housing 11.

Figure 4:
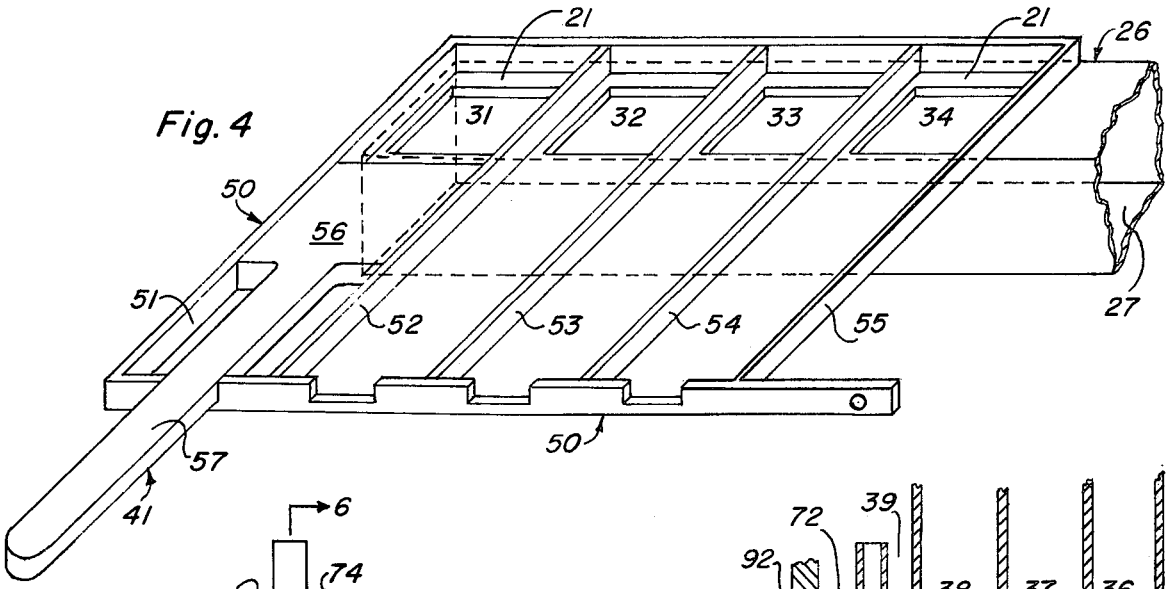
FIG. 4 is a perspective view of a substructure associated with the game board for slidably mounting of control valves for controlling the starting, acceleration, decelaration and stopping of all movement on individual surface tracks and areas of the top of the board, and also illustrating in full and dotted lines a portion of the underlying air pressure chamber.
Figure 5:
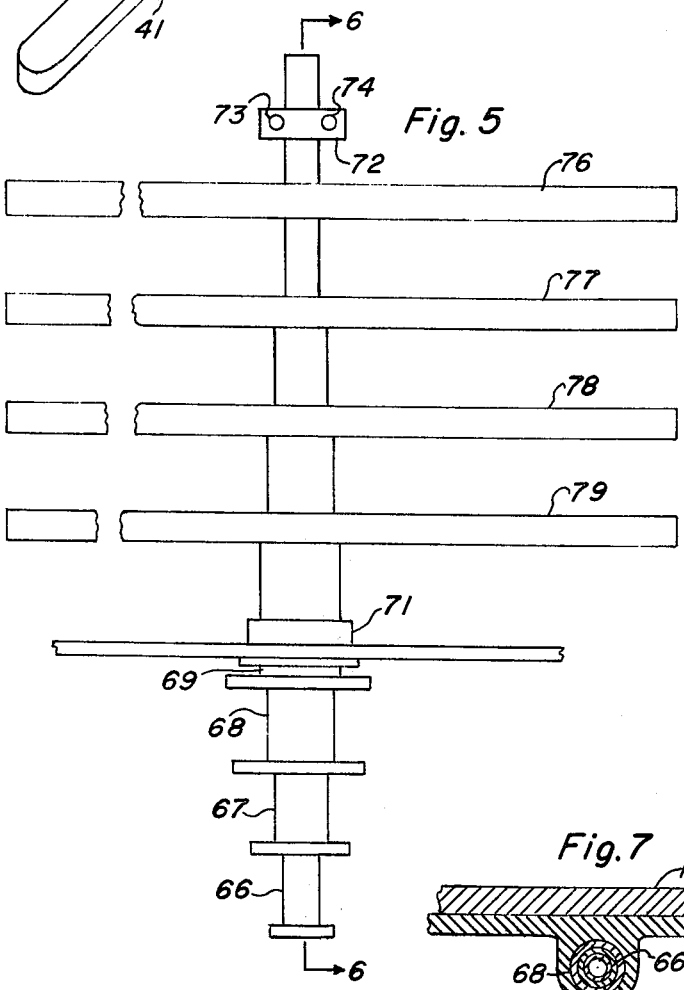
FIG. 5 is a fragmentary broken plan view of a control mechanism secured to the underside of the top of the game board and utilized in an embodiment of my present invention for singly controlling movable objects.
Figure 6:
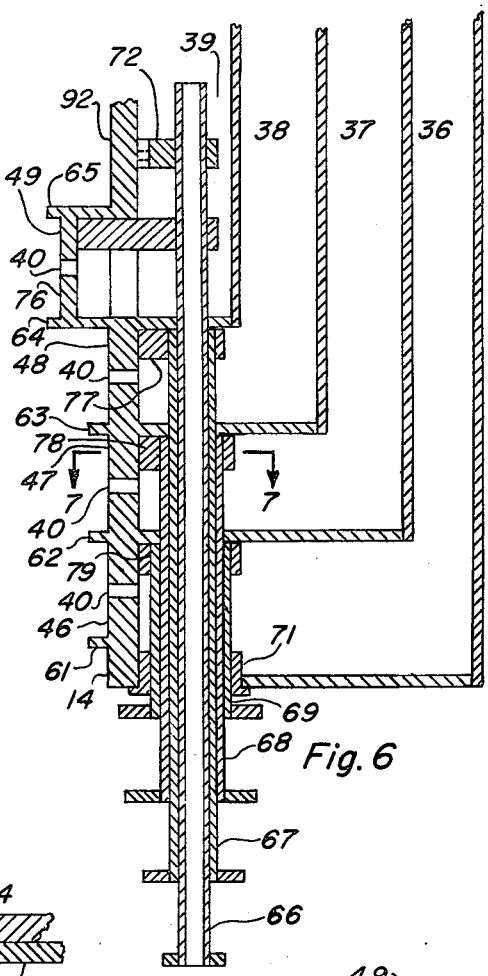
FIG. 6 is a fragmentary cross-sectional view taken on the line 6—6 of FIG. 5; this view showing the control mechanism attached to the underside of the top of the game board and to the front of the housing.
Figure 7:
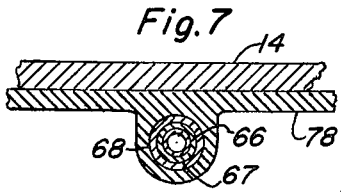
FIG. 7 is an enlarged fragmentary sectional detail of the valve control system shown in FIG. 6 and taken on the line 7—7 thereof.

With particular reference to FIGS. 2 and 4 of the accompanying drawings, it will be noted that my present invention in a multiple-track system includes a series of manually operable slide valves 41, 42, 43 and 44 for controlling the volume of air under pressure which will be caused to emanate from the air pressure chamber 27 through the apertured bottom 21 of housing 11 into and through the air conduits 36, 27, 38 and 39 and out jet holes 40 and 40′. The slides valves are conveniently mounted in a substructure, designated generally by the reference numeral 50 and comprising channeled partitions 51, 52, 53, 54 and 55 for slidably receiving opposite sides of enlarged sections 56 of the valves; such substructure 50 resting on the tops of the air conduits with the handles 57 of the slide valves extending outwardly from the housing 11 for ready manipulation by pulling on the handle 57 of each of the slide valves outwardly which will open the ports or apertures 31, 32, 33 and 34 or any one of such apertures as desired or selected to admit a given amount of air under pressure to the jet holes 40; while pushing of such slide valves toward the housing 11 or inwardly will partially or fully close such apertures to diminish or shut off air flow from pressure chamber 27 to the jet holes, thus controlling the speed of movement of selected movable objects along and around the oval tracks defined by enclosure walls 61, 62, 63, 64 and 65, see FIG. 4, of each track, as well as other modular components placed upon defined areas of the top 14 of the game board.

As shown in FIGS. 1 and 2, I provide additional control mechanism for regulating the movement of individual or single objects within tracks 46, 47, 48 and 49; such control mechanism comprising a plurality of telescopically arranged concentric tubular members 66, 67, 68 and 69 mounted on the underside of the top 14 of housing 11 at its approximate transverse center by means of a bearing 71 and an arched bracket 72 secured by means of spaced apart screw 73 and 74 piercing the apertured flanges of such bracket and entering the underside of the top 14 of the housing 11. Each of the tubular members 66, 67, 68 and 69 carries a laterally extending valve element 76, 77, 78 and 79, respectively, for covering and uncovering jet holes 40 communicating with the superposed air conduits 36, 37, 38 and 39, respectively, upon the outward pull and the inward push of the telescopically arranged members 66 to 69 inclusive, thereby controlling the starting and stopping of individual movable objects in the tracks 46, 47, 48 and 49, whenever desired, over a distance equal to the length of the valves 76, 77, 78 and 79, as distinguished from starting and stopping all movable objects in such tracks as a group by opening and closing slide valves 41, 42, 43 and 44. It is of course to be understood that one, two or more movable objects can be controlled in the tracks by manual mnipulation of said slide valves individually and collectively.

Figure 8:
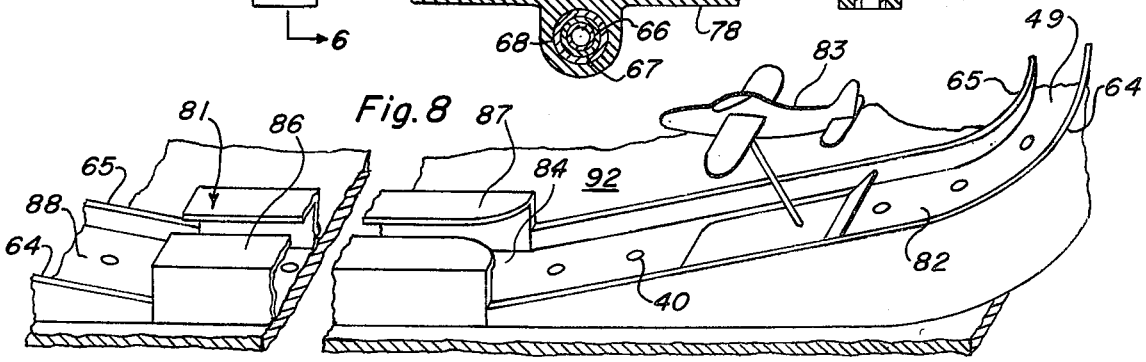
FIG. 8 is an enlarged fragmentary and broken perspective view of the superstructure of my improved game board utilized in an embodiment of my invention; this view showing an aircraft modular descending toward a landing strip.
Figure 9:
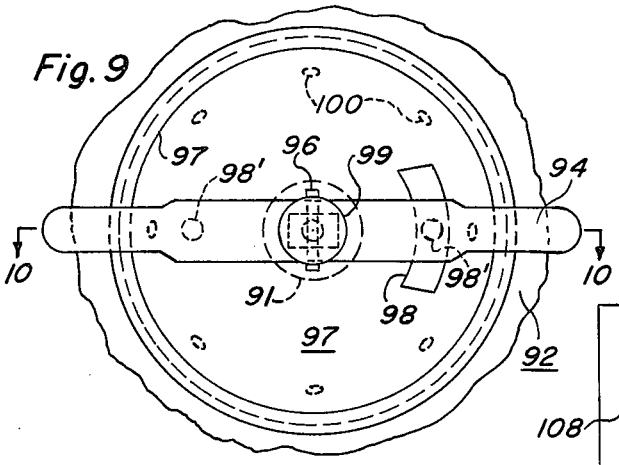
FIG. 9 is a broken top plan view of a modular object that can be removably placed over any selected one of a plurality of enlarged modular openings in the top of the embodiment of my invention illustrated in FIG. 1.
Figure 13:
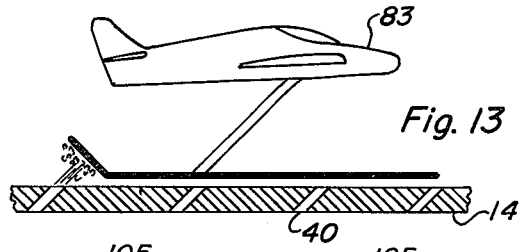
FIG. 13 is an elevational view of a toy aircraft carrying an assist-vane and movable over a surface in response to air under pressure suitably valve-controlled as to speed regulation of the craft; this view fragmentarily showing a portion of the vented top surface of my improved game board.

In accordance with my present invention, I provide within track 49, at approximately the longitudinal center thereof, an aircraft landing and take-off strip which is designated generally by the reference numeral 81, see FIG. 2, and which includes a downwardly inclined section 82 sloping to the runway of track 49 thereby simulating the bringing in of a toy aeroplane 83, see FIGS. 8 and 13, to an unloading as well as a loading area 84 and to a rest position between a pair of raised and overlying clamps 86 and 87 disposed in a confronting relation on opposite sides of track 49, as well as an upwardly inclined section 88 to simulate a take-off of the toy aeroplane when moved from the rest position by jets of air forced through air holes 40 from air conduit 39 upon operation of blower 28 and opening telescopic valve 69.

As particularly illustrated in FIGS. 9 to 20 inclusive of the annexed drawings, I provide means for effecting and controlling the movements of other modular objects or components in addition to the movement of the aircraft module 83. The additional modular components conveniently are operatively placed in the area 24 of top 14 of my improved game board whereas the aircraft module 83, as described above, is operable in the track area 23 and specifically track 49 of the top of the board. Some of the additional modular components are three-dimensional while others are silhouettes, but all are pneumatically moved, stopped and started. To illustrate, reference is made to FIGS. 9 and 10 of the annnexed drawings where I have depicted a teeter-board module, which is generally designated by the reference numeral 90 and which can be placed over the relatively large normally closed vertical modular opening 91 in the infield area 92 of the multi-track section 23 of the board top 14. As shown, a centrally apertured board is provided and mounted on an upright or standard 93 with one-half of the board 94 extending to one side of the standard and the other half of the board extending to the other side of such standard. Any suitable means can be employed to mount the board, such as a shaft 96 which pierces the standard and extends at opposite sides thereof into the teeter-board, thus enabling opposite ends to pivot about the shaft and to rise and fall when propelled to simulate a see-saw.

For effecting the propulsion of the teeter-board, I movably mount on standard 93 a circular disc 97 having an aperture 98 therein which is caused to rotate about the standard by means of jets of air emanating from inclined jet holes 100 and impinging upon the bottom surface of the disc 97 to cause it to revolve about the standard and thus bring the aperture 98 in the disc 97 into intermittent registry with the two vertically disposed underlying jet openings 98′, first on one side of the standard 93 and then on the other, thereby releasing upwardly jets of air from the underlying air chamber 100′ of the teeter-board module 90 which entered chamber 100′ through the uncapped vertical modular aperture 91 from super-posed air conduit 39, with which it is in communication, to impinge upon the underside of first one end and then the other end of the teeter board to cause the board to rise and fall. An attractively designed element 99 is press-fitted onto the upper end of the standard 93 of the teeter-board modular component 90; such element 99 being coated, if desired, with a fluorescent paint to enhance the attractiveness of the simulated see-saw and to invite attention thereto. It is clear that the see-saw can be caused to operate during racing action on the oval tracks.

Figure 12:
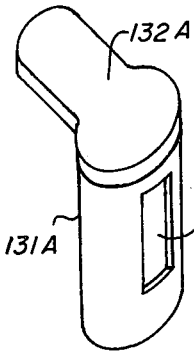
FIG. 12 is a perspective view of the movable valve element for controlling to and fro linear movements of modular objects removably placed on the two-way track shown in FIG. 1, such movable valve element being removably inserted in the fixed valve member shown in dotted lines in FIG. 11.
Figure 11:
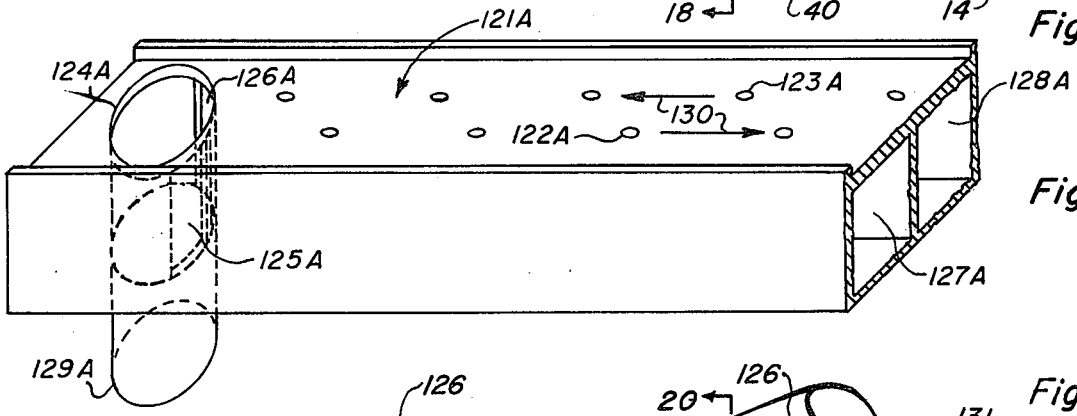
FIG. 11 is a fragmentary perspective view of a portion of the top of my improved game board with still another removable modular object embodying a single track two-way unit for moving an object to and fro linearly; this view showing in dotted lines a two-part fixed valve member with fixed extension sleeve as well as a portion of the single track air conduits.

A still further modular component utilizable in my present multiple track system is shown in perspective view in FIGS. 11 and 12 of the annexed drawings which can be set up or placed in any selected one of a plurality of positions in the modular component area 24 of top 14 of my improved game board. As shown, I provide a single interiorly divided two-way track structure 121A fashioned with two centrally located sets of jet holes 122A and 123A of which one linearly arranged set of jet holes is inclined in one direction, and the other set of jet holes is inclined in the opposite direction. One end of the two-way track 121A is fashioned to provide a vertically disposed tubular cavity 124A having two ports 125A and 126A therein which open to the air conduits 127A and 128A respectively of the two-way track structure 121A. To establish communication between the two-way track structure 121A and the pressure air chamber 27 of housing 11, I provide a sleeve 129A which conveniently is press-fitted into the lower end of cavity 124A and which serves as a connector between such cavity and an uncapped vertical modular relatively large circular opening 45 in top 14 of housing 11, the opening 45 in communication directly with the lower air conduit 36 underlying the top 14 and, in turn, communicating by slide valve control with air pressure chamber 27, see FIG. 3.

To effect the controlled movement of any selected modular object in a to and fro motion over the top 14 of the game board, I provide a modular valve element 131A which is provided with an integral laterally extending handle 132A thereon and which is fashioned in tubular form with a single valve port 133A therein, see FIG. 12 of the drawings. The modular valve element 131A is removably fitted into cavity 124A of the two-way track structure 121A and rotatable therein. By grasping the extended handle 132A of such valve element, and turning the same to the left and right, the single port 133A will be placed first in registry with the cavity port 125A and then with the cavity port 126A so that jets of air will be released from air pressure chamber 27 under control of the slide valve 41, see FIG. 3, through aperture 31 of the bottom 21 of housing 11 into the air conduit 36 and thence through modular opening 45 in top 14 into first air conduit 127A to be emitted to the underside of the modular object, not shown, through inclined jet holes 122A and second into the air conduit 128A to be emitted through oppositely inclined jet holes 123A to impinge onto the bottom of the modular object, not shown, to propel the object to and fro over the two-way track 121A as indicated by the oppositely directed small arrows 130, see FIG. 11. Of course, a modified embodiment of the two-way track 121A to effect to and fro movement can be incorporated as an integral part of housing 11 with a side track communicating with one of the main tracks 46–49 inclusive; said side track having inclined jet holes arranged in opposite directions so that a modular vehicle can be moved off such main track as well as back onto such main track, when desired.

In the following descriptions where reference is made to two-wheeled and four-wheeled modular vehicles, it is to be especially noted that the wheels on all vehicles are mounted for free-floating vertical movement and that although by force of gravity the wheels effect a rolling frictional engagement with the surface of a track, in no instance do the wheels support the weight of the modular vehicle.

Figure 14:
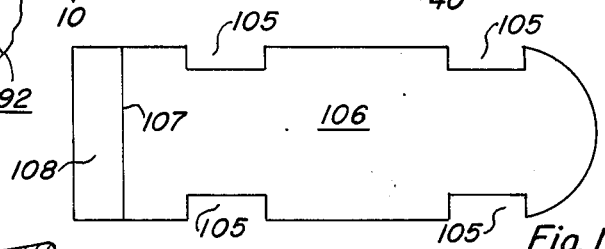
FIG. 14 is a top plan view of a mount with an assist-vane for a toy four wheel auto which can serve as one modular component for removable placement on the top surface of the game board.
Figure 10:
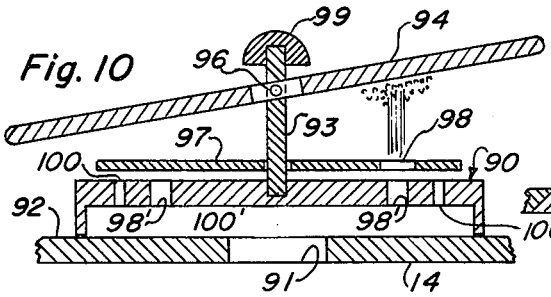
FIG. 10 is a fragmentary sectional elevational view of the modular object illustrated in FIG. 9 and taken on the line 10—10 thereof; this modular objedt containing a simulated see-saw.
Figure 15:
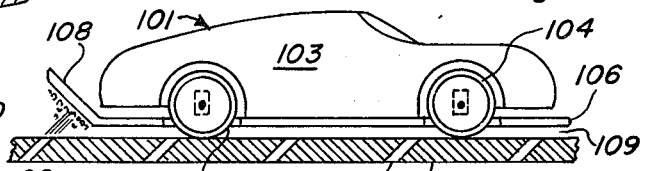
FIG. 15 is a side elevational view of a modular component embodied in a four wheel toy auto adhesively attached to the mount shown in FIG. 14 with the assist-vane of the mount elevated; this view showing in fragmentary cross-section a portion of the vented top surface of my improved game board and depicting the air cushion between the mount and such game board top over which the module is moved.

In FIGS. 14 and 15, I have illustrated a three-dimensional modular object which is exemplified in a miniature four wheel auto for utilization whenever desired into the game board and pneumatic drive system of my present invention. As shown, the specially constructed miniature or toy auto, which is designated generally by the reference numeral 101 includes a body 103 having cut-out areas for the reception of four wheels 104 of which but two thereof are shown in the side elevational view of FIG. 15. The wheels 104 fit into cut-out areas 105 of a flat sheet 106, see FIG. 14, and the bottom of the toy auto 101 is adhesively attached to the mount or flat sheet 106. The mount 106 is conveniently fashioned from a suitable transparent material, such as thin glass or a translucent plastic, but can be formed from a light-weight metal such as aluminum if desired. The sheet 106 is provided with a transverse score line 107 therein so as to afford an assist-vane 108 in the sheet which is bent upwardly, as shown in FIG. 15 to receive the impinging jets of air under pressure from the jet holes 40 in top 14 of housing 11 and to augment the air under pressure impinging against the flat sheet 106 on the bottom of the toy auto 101 thereby appreciably aiding in the propulsion of the toy vehicle along the tracks of the multiple-track area 23 on the top 14 of housing 11. Operation of the blower 28 by starting motor 29 by the throw of switch 30 will cause the flow of air under pressure through conduits 36, 37, 38 and 39 under manipulated slide valves 41, 42, 43 and 44 to deliver jets of air from pressure chamber 27 through the aforesaid air conduits and through inclined jet openings 40 to be released against the assist-vane 108 and upon the flat underside of the mount 106 to thus cause the toy auto 101 to ride along linearly on a cushion of air, as indicated at 109 in FIG. 15. This action can occur in one oval track 46 and if duplicate vehicles are cemented on duplicate mounts, can occur in two, three or all four tracks of the oval tracks 46–49 inclusive.

A somewhat similar modular object, such as a two-wheel silhouette of a miniature vehicle in automobile simulation, is illustrated in FIGS. 16, 17 and 18 of the annexed drawings. In this modification I provide in combination a mount 111 fashioned with spaced elongated apertures 112 and 113 therein and fashioned with a transverse score line 114 to afford an assist-vane 115 and a silhouette body 116 having cut-out spaced apart sections for the accomodation of simulated car wheels 117 and 118 which are removably fitted into the elongated apertures 112 and 113 of the sheet 111 which is suitably fabricated or molded from similar material as used in fashioning the sheet 101, but especially from a transparent plastic material. As in the case of the modular componet of FIGS. 14 and 15, the sheet 111 is bent on score line 114 to enable placement of the assist-vane in an angularly raised position at the rear of the body 116; such combination of mount and miniature silhouette body being adapted to be moved along linearly over the top 14 of my improved game board to desired controlled speeds by means of air under pressure delivered from air chamber 27 through the air conduits 36 to 39 inclusive and inclined jet holes 40 to impinge on the assist-vane and to ride on a cushion of air as indicated at 119 in FIG. 17, between the underside of mount 111 and the game board top 14. It is to be especially observed that in the modular component illustrated in FIGS. 16, 17, and 18, each of the car wheels 117 and 118 is mounted in a vertically arranged slot 120 in body 116 by means of an integral stub-shaft 121 which extends through the slot allowing the vehicle to have free-floating frictional engagement with a track surface and affording a realistic wheel spinning movement with respect thereto.

Another modification of a modular component utilizable in my improved multiple track system is illustrated in FIGS. 19 and 20 of the accompanying drawings. This modular component omits any mount and comprises a miniature four wheeled toy automobile consisting of a body 126 having an integral assist-vane 127 formed on the rear of the body with cut-out areas in which car wheels 128 and 129 are mounted on front and rear axles 131 and 132, respectively. The wheels 128 and 129 engage the surface of a track on top 14 of the game board and are rotated by frictional engagement with such track surface; the body 126 being propelled in a linear direction by jets of air emanating from a series of jet holes 40 which impinge upon the flat bottom of the body of the auto and upon the assist-vane 127 of the body at the rear thereof. Two or more of the jet propelled bodies, or a single body 126, may be placed in the tracks 46, 47, 48 and 49, as desired.

It will be noted that in FIGS. 10, 13, 15, 17, 18, 19 and 20 the space depicting the air cushion is greatly exaggerated for clarity, and that when the switch 30 is thrown to start motor 29 and blower 28, the resulting cushion of air between the top 14 and the modular object is, in fact, measurable in a thousandths of an inch. It will be further noted that as the air passes through the jet holes 40 and between the flat bottom of a moving module object and the surface of a track, the high velocity of the air so reduces the pressure between such flat bottom and track surface that the atmospheric pressure tends to hold the module on the track. Consequently, regardless of how fast the vehicles are made to travel by virtue of the manipulation of the control valves, the greater the air flow the greater is the tendency of the propeled vehicles to adhere or to cling to a track surfce. There is no need, therefore, to slope track retaining walls inwardly, or to bank the curves for the singular purpose of holding the vehicles on the track. The foregoing is in accordance with the well known Bernoulli principle. It will be still further observed that when the modules are moving at high speed an undesirable static charge tends to build up on the bottom surface of each module which tends, in turn, to retard the forward movement of the module. To counter-act and overcome this static charge build-up, I provide an inlaid metal strip, designated by the reference numeral 15 and fabricated of relatively thin brass, copper or steel and arrange the strip transversely of the several tracks 46, 47, 48 and 49 with the upper surface of the strip flush with the surfaces of the tracks so that as the modules pass across the strip in their travel around the tracks any static charge that may have accumulated on the bottom surfaces thereof will be discharged thus cancelling out the undesirable drag. Tests that I have made with and without such metal strip 15 bear out the above theoretical explanation of what occurs in relation to the lack of drag on the moving modules when the strip 15 is installed.

In addition to the modular components illustrated in FIGS. 9 to 20 inclusive of the annexed drawings, it seems clear that other types of movable objects can be set up in the multiple track area 23 of the improved game board as well as in the modular component area 24 thereof, such as ferris wheels with assist-vane surfaces upon which jets of air can be caused to impinge at greater or lesser air flow, or such as merry-go-rounds, windmills and similar objects. All of the added modular components can be set in motion simultaneously or singly, and the speed thereof as a group as well as individually are controllable by manual manipulation of the slide valves 41 to 44 inclusive or any one of them and by manipulation separately of the telescopically movable concentrically arranged valves 66 to 69 inclusive, or by movement of any one of them.

It is to be understood that the appended claims are intended to cover the embodiments illustrated in the annexed drawings as well as modifications therof within the scope and purview of my invention.

I claim:

1. A controlled multiple track toy system with modular attachments comprising a housing, a top on said housing, an endless track defining a plurality of endless lanes delineated on said top, a plurality of air jet holes in said top of which some of the holes are vertically arranged through said top and some thereof are inclined in one direction from the vertical and some thereof are inclined in the opposite direction from the vertical, all of said air jet holes communicating with the interior of said housing, a plurality of modular attachments removably disposable in a plurality of areas about said top: each of said modular attachments having an opening therein aligning with said vertically arranged air jet holes, a modular object supported on each of said modular attachments; each of said modular objects having an aperture therein communicating with the opening in said modular attachment on which it is supported, a movable object removably disposable in each lane of said endless track, means for causing air to flow through said housing and to emanate under pressure from said air jet holes to impinge upon said plurality of modular objects and movable objects to move the same in relation to said top, and a plurality of independently movable control means for selectively varying the volume and pressure of air impinging upon selected ones of said plurality of modular and movable objects to vary the speeds thereof as a group and singly.

2. A controlled multiple track toy system with modular attachments as set forth in claim 1, and a superstructure on said top of said housing defining a simulated aircraft landing and take-off strip comprising a level section, a downwardly inclined section merging with said level section at one end thereof, and an upwardly inclined section merging with the other end of said level section, a series of air jet holes in said level section and said downwardly inclined section and in said upwardly inclined section of said superstructure; all of said air jet holes being inclined in the same direction from the vertical, and an additional modular object simulating a toy aeroplane removably disposable on said superstructure and movable in said downwardly inclined section and in said level section and in said upwardly inclined section of said superstructure in response to jets of air emanating from said air jet holes and impinging upon said additional modular object, and means for stopping said additional modular object in an at rest position within said level section which simulates a station for unloading and loading of the aircraft as well as for starting the movement of said additional modular object from said level section up said upwardly inclined section of said superstructure to simulate the take-off of an aeroplane; said additional modular object being adapted to be moved simultaneously with the movement of one or more of said plurality of modular objects as well as independently thereof.

3. A controlled multiple track toy system with modular attachments as set forth in claim 1, said top having at least two vertically arranged air jet holes therein arranged in spaced apart locations, a first modular attachment having an opening therein removably disposable on said top with its opening in alignment with one of said two vertically arranged air jet holes, a movable object supported on said first modular attachment; said movable object simulating a teeter-board and movable up and down above said top in response to impinging jets of air under pressure applied alternately to opposite ends of said teeter-board and supplied through said one of said two vertically arranged air jet holes, and a second modular attachment having an opening therein and removably disposable over the other of said two verticually arranged jet holes for movement of impinging jets of air emanating through said other of said vertically arranged jet holes.

4. A controlled multiple track toy system with modular attachments as set forth in claim 3 wherein said second modular attachment comprises a hollow casing defining a vertically arranged compartment in valve-controlled communication with a partitioned horizontally arranged chamber providing separated juxtaposed conduits therein, a top on said casing having a plurality of spaced apart uniform size air jet holes therethrough communicating with said juxtaposed conduits and which are arranged to simulate a two-way track wherein the jet holes in one side of said two-way track are inclined in one direction from the vertical and the jet holes in the other side of said two-way track are inclined in the opposite direction from the vertical, an object simulating a vehicle removably disposed on said top of said casing in overlying relationship to said uniform size air jet holes therein, means for causing jets of air under pressure to emanate first from said jet holes on said one side of said two-way track to impinge upon said object simulating a vehicle and thus move the same in one linear direction and then to emanate from the air jet holes on the other side of said two-way track to impinge on said object simulating a vehicle and move the same in the opposite direction, and means for alternately shutting off emanation of air under pressure from said one side and said other side of said two-way track thereby giving reciprocating linear motion to said object simulating a vehicle over the top of said casing.

5. A controlled multiple track toy system with modular attachments as set forth in claim 1, wherein at least one of said plurality of modular objects is three dimensional simulating a toy automobile and comprising a sheet having apertures therein opening to opposite sides thereof, a body adhesively secured to said sheet, four wheels on said body filling said apertures of said sheet, and an assist-vane on one end of said sheet tilted from the horizontal upon which jets of air under pressure impinge to augment the impinging jets of air applied to the underside of said sheet from said air jet holes whereby said three dimensional modular object is moved linearly over the top of said housing.

6. A controlled multiple track toy system with modular attachments as set forth in claim 5 wherein said four wheels are floatingly mounted on said body and engage the surface of one of said tracks by force of gravity and simulate spinning action thereon.

7. A controlled multiple track toy system with modular arrachments as set forth in claim 1 wherein at least one of said plurality of modular objects comprises a silhouette body, at least two surface-engaging wheels floatingly mounted on said body, a transparent sheet adhesively secured to the bottom of said body and having two elongated apertures therein through which said two surface-engaging wheels extend, and an assist-vane on one end of said sheet tilted at an angle to the horizontal upon which jets of air under pressure are caused to impinge thereby augmenting the jets of air caused to impinge upon the underside of said sheet whereby said silhouette body is caused to move over one of said tracks defined in the top of said housing.

8. A controlled multiple track toy system as set forth in claim 1 wherein at least one of said plurality of modular objects comprises a three-dimensional body simulating a miniature racing car having at least two vertical slots therein, at least two surface-engaging wheels mounted for free-floating movement within said vertical slots, a stub axle on each of said wheels extending through said vertical slots to permit free-floating mounts for said wheels, an elongated transparent sheet having at least two apertures therein for passing said wheels adhesively secured to the bottom of said body, and an assist-vane on one end of said sheet tilted at an angle to the horizontal upon which jets of air emanating from said air jet holes in said top of said housing are caused to impinge to augment the impinging jets of air applied to the bottom of said sheet thereby to move said three-dimensional body along the surface of one of said tracks defined in the multi-track area of the top of said housing with said free-floating wheels spinning on said surface.

* * * * *